United States Patent [19]

Braum

[11] 4,105,105

[45] Aug. 8, 1978

[54] METHOD FOR CHECKING COINS AND COIN CHECKING APPARATUS FOR THE PERFORMANCE OF THE AFORESAID METHOD

[75] Inventor: Ludwig Braum, Laufen, Germany

[73] Assignee: Libandor Trading Corporation Inc., Monrovia, Liberia

[21] Appl. No.: 724,768

[22] Filed: Sep. 20, 1976

[30] Foreign Application Priority Data

Oct. 17, 1975 [DE] Fed. Rep. of Germany ..... 2546685
Nov. 3, 1975 [DE] Fed. Rep. of Germany ..... 2549093

[51] Int. Cl.[2] ..... G07F 3/02

[52] U.S. Cl. ..... 194/100 A; 194/99; 324/236

[58] Field of Search ..... 194/99, 100 R, 100 A, 194/102, 97 R; 209/81 R, 81 A; 73/163; 324/34 R, 37, 40

[56] References Cited

U.S. PATENT DOCUMENTS

| | | | |
|---|---|---|---|
| 2,660,704 | 11/1953 | Harmon et al. | 324/34 R |
| 3,506,103 | 4/1970 | Kückens et al. | 194/100 R |
| 3,738,468 | 6/1973 | Prumm | 194/100 A |
| 3,741,363 | 6/1973 | Hinterstocker | 194/100 A |
| 3,768,618 | 10/1973 | Collins | 194/102 |
| 3,870,137 | 3/1974 | Fougere | 194/100 A |
| 3,901,368 | 8/1975 | Klinger | 194/100 A |

FOREIGN PATENT DOCUMENTS

| | | | |
|---|---|---|---|
| 205,532 | 11/1956 | Australia | 324/34 R |

*Primary Examiner*—Robert B. Reeves
*Assistant Examiner*—Joseph J. Rolla
*Attorney, Agent, or Firm*—Werner W. Kleeman

[57] ABSTRACT

A method of, and apparatus for, checking coins, wherein the coin to be checked is moved through a constantly regulated alternating-current field of a measuring coil. The influence of the coin upon the alternating-current field produces a regulation magnitude formed from the difference between a reference voltage and the rectified oscillator-measuring voltage. The regulation magnitude readjusts, by means of the oscillator circuit, the oscillator-measuring voltage at the measuring coil to a constant value. During coin checking the regulation magnitude is employed as the coin checking criterion in a manner such that it is possible to determine by means of an evaluation circuit whether this regulation magnitude has reached a value falling within an upper and lower boundary. The time-constant of the regulation circuit is chosen such that slow changes can be controlled, but the oscillator-measuring voltage is also maintained constant during relatively rapid passage of the coin through the measuring coil and there is obtained as high as possible amplitude of the regulation magnitude.

31 Claims. 13 Drawing Figures

METHOD FOR CHECKING COINS AND COIN CHECKING APPARATUS FOR THE PERFORMANCE OF THE AFORESAID METHOD

BACKGROUND OF THE INVENTION

The present invention relates to a new and improved method for checking coins and to a coin checking apparatus for the performance of the aforesaid method.

A heretofore known method of checking coins contemplates conducting the coins to be checked in succession through both alternating-current fields of two successively arranged oscillator coils dimensioned such that at the first oscillator coil, when influenced by a "proper" coin, the oscillations of the oscillator just begin to breakdown and at the second oscillator coil the oscillations do not yet breakdown. The different dimensions of both oscillator coils govern the permissible stray range for a certain type of coin. Only when, as described, the one oscillator stops and the second does not, is the coin accepted. While this technique can be put into practice economically, still it is qualitatively unusable. The criterion "stopping of the oscillations of the oscillator", of all conceivable criteria, is the one which is most temperature-dependent, and even with constant environmental conditions is not accurately reproducable.

According to a further prior art process for checking coins there is employed a bridge-measurement circuit. This technique has become known in numerous modifications. While it has the advantage of extreme accuracy, it is associated with the drawback that it is difficult to fabricate at relatively high manufacturing costs and equally is not suitable for use as a multiple-coin checking device. It is characterized by a bridge which in one of its branches is pre-loaded either by an original coin or an appropriate electrical magnitude and the other branch is loaded by the coin to be checked. What is evaluated is the one-time self-adjustment of the null voltage, which only can be obtained if the strictly predetermined original coin is compared with an equivalent coin.

Further state-of-the-art methods utilize the damping of a transformer by means of a coin moving therepast which is to be checked, and owing to the influence of the coin there is reduced the HF—no load—amplitude at the secondary. The degree of damping, i.e. the maximum amplitude of a negative measurement voltage at the secondary, is used as the criterion for the recognition of a coin type.

Another group of already known coin checking methods employ the evaluation of positive measurement voltage amplitudes at the secondary, as such occur during de-tuning of symmetrically constructed differential-transformer probes.

Both the evaluation of the maximum damping at the secondary as well as the evaluation of the maximum non-symmetry at the secondary result in good recognition of the different coin types. But both techniques are associated with the drawback that they require complicated circuit design to obtain good temperature stability. In any event both of the last-mentioned methods enable, by means of a single measurement arrangement, the recognition of different types of coins, since there only must be utilized a corresponding number of window circuits in order to monitor the measurment voltage regions corresponding to the individual coin types to be checked. However, with both methods the circuits required are critical and expensive to manufacture.

SUMMARY OF THE INVENTION

It is a primary object of the present invention to provide a new and improved method of, and apparatus for, checking coins which is not associated with the aforementioned drawbacks of the heretofore known techniques.

Another and more specific object of the present invention aims at the provision of a new and improved method of, and apparatus for, checking coins wherein the system is capable of operating over a wide temperature range extremely temperature-independent, renders possible the checking of a number of different types of coins by means of only a single measuring arrangement arranged at a single coin path destined for all coin types, possesses good recognition accuracy, and above all can be realized in a simpler, less expensive and less complicated manner.

Now in order to implement these and still further objects of the invention, which will become more readily apparent as the description proceeds, the inventive method is manifested by the features that the coins to be checked are moved through the constantly regulated alternating-current field of a measuring coil, the influence of the coin upon the alternating-current field produces a regulation magnitude formed from the difference between a reference voltage and the rectified oscillator-measuring voltage. The regulation magnitude regulates, by means of an oscillator circuit, the oscillator-measuring voltage at the measuring coil to a constant value. The regulation magnitude is employed as the criterion during coin checking in a manner such that by means of an evaluation or monitoring circuit there is determined whether such regulation magnitude has reached a value which is within an upper and lower boundary. Further, the time-constant of the regulation circuit is chosen such that, on the one hand, slow changes, for instance due to drifts of the circuit components, are controlled or stabilized, on the other hand however also the oscillator-measuring voltage is maintained constant with relatively rapid passage of the coin through the measuring coil and there is obtained as high as possible amplitude of the regulation magnitude for the coin checking circuit.

The oscillator coil can be simultaneously employed as the measuring coil. However, it is also possible to use as the measuring coil a coil which is galvanically coupled with the oscillator coil or a transformer-coupled coil. Additionally, the invention is also concerned with coin checking apparatus for the performance of the aforementioned method aspects which is manifested by the features of a circuit arrangement containing an oscillator oscillating at a predetermined frequency and which can be influenced by a regulation voltage through the agency of an influencing element, for instance a regulatable resistor, in such a manner that the oscillator amplitude can be regulated without distortion in accordance with the regulation amplitude at the input of the oscillator. The operating point of an amplification transistor in the oscillator circuit can be fixed by an absolute fixed reference voltage or a reference voltage obtained by voltage dividing the operating voltage, which upon change of such operating voltage influences the position of the operating point of the amplification transistor in the oscillator circuit such that the no-load oscillator measuring voltage and the reference voltage, irrespective of magnitude, always have the same relative relationship to one another. Rectifying means rectify the oscillator-measuring voltage tapped-off of the measuring coil. A differential amplifier forms the regulation magnitude from the difference of this rectified oscillator-measuring voltage and a reference voltage. By means of a feedback loop having a defined time-constant and the influencing element the regulation magnitude influences the oscillator such that the rectified oscillator-measuring voltage and the reference voltage coincide. An evaluation circuit compares the regulation magnitude of the differential amplifier, caused by the influence of a coin upon the alternating-current field of the measuring coil, with a predetermined potential window having a lower and an upper threshold value and accepts the coin when such regulation magnitude lies within the potential window. The circuit arrangement is constructed such that the time constant of the timing element of the feedback loop and the differential amplifier, on the one hand, is of such duration that there does not occur any control or regulation-out of the half waves of the non-rectified oscillator-measuring voltage and, on the other hand is so short that even when receiving as large as possible amplitude of the regulation magnitude as the criterion for the coin checking there does not occur any appreciable change of the oscillator-measuring voltage at the measuring coil during rapid throughpass of a coin.

According to the invention there is proposed for the first time, as the criterion when checking a coin, the utilization of the regulation magnitude required for maintaining constant the alternating-current field of the measuring coil during passage of a coin through the magnetic field of the measuring coil.

This will be explained more fullly hereinafter: As will be apparent for instance from FIG. 1 an oscillator having a measuring coil as the oscillator measuring coil is operated via an influencing element (for instance a voltage divider which can be controlled at its center tap, a regulatable resistor or the like), such that there is produced in the measuring coil a given oscillator voltage $U_N$ at a predetermined frequency F, which is tapped-off and rectified. This rectified no-load or idling measuring voltage $U_G$ and a reference voltage $U_{Ref}$ are delivered to a differential amplifier which, by means of the influencing element located at the input of the oscillating circuit, stabilizes or controls deviations of the voltage $U_N$ for such length of time until $U_G$ and $U_{Ref}$ again coincide. The differential amplifier thus compensates all temperature- or other long duration effects upon the voltage $U_N$ or $U_G$ respectively, whether of an electrical nature (component drift) or mechanical nature (expansion and so forth). In order to prevent that the differential amplifier also will control or regulate-out the amplitude of a sinusoidal oscillation of the oscillator it has an appropriately dimensioned time-constant which for this purpose functions as the regulation delay.

The regulation voltage $U_R$ resulting from the temperature- and long-time influences which are to be controlled or stabilized is extremely small and approximately equal to null during idling or no-load, since such influences slowly slip away. The no-load condition of the proposed measuring circuit is thus characterized by a constant maintained voltage $U_G$ of a certain magnitude and a regulation voltage $U_R$ of a certain amount (in the ideal case amounting to null), and thus $U_G = U_{Ref}$.

Experience has shown that coins in a given coin checking apparatus always pass the measuring arrangement with approximately defined velocity, and specifically, independent of whether they roll, slide or drop. As a function of the selected mechanical construction the speed of movement of the coins thus is defined within a certain region and this given speed of movement of coins must be taken into account for the selection of the time-constant of the differential amplifier and the timing element of the feedback loop as well as the operating frequency.

If, for instance, a coin drops, with the proposed method, through the field of the coil of the oscillator-tank circuit, then the influence upon the tank circuit, brought about by the coin, is immediately counter-regulated via the differential amplifier, so that the voltage $U_N$ present at the measuring coil cannot decrease. Corresponding to the influence of the coin there thus is formed, as the regulation magnitude, a regulation voltage for compensating such influence, which is tapped-off and, as proposed, can be used directly as the new criterion for the coin measurement, because its value is proportional to the effect of the coin upon the tank circuit and is available as a positive rectified signal voltage. As will be apparent from the discussion of the following exemplary embodiments it is possible to realize, with the proposed method, simple, inexpensive and especially non-sensitive and temperature-stable measurement arrangements for coins.

As the regulation magnitude for the criterion for checking of the coins there can be employed, for instance, the regulation voltage or regulation current. The examples discussed hereinafter relate to the evaluation of a regulation voltage. However, it is here mentioned that of course it would be equally possible to evaluate the regulation current.

With a single measuring coil it is possible to check a number of different types of coins. But in those instances where the required checking accuracy is not adequate, it is possible to also use two or more tank circuits and to check each coin in succession in the different oscillating or tank circuits. The individual oscillating or tank circuits advantageously operate at different frequencies and thus provide different information regarding a certain type of coin. In those cases where there are employed for checking the coins two or more coils for oscillating circuits operating at the same frequency, the oscillating circuits are advantageously slightly detuned relative to one another in order, in this manner, to eliminate any mutual influence upon one another.

When employing the teachings of the inventive method it is immaterial whether the oscillator is operated predominantly unstable and the regulated magnitude (voltage or current) is exclusively assigned the function of maintaining constant the oscillator-measuring voltage of the measuring coil (or better: the rectified oscillator-measuring voltage at the input of the differential-amplifier), or whether the frequency and voltage are stabilized and the current regulated, or only the voltage stabilized and the current regulated, or only the current stabilized and the voltage regulated. These different possibilities are available; the choice is left to the circuit designer in consideration of the component expenditure.

With the inventive method the proper selection of the suitable time-constant for the regulation circuit is decisive. This must be tuned to the throughpass time of the coins to be checked and the selected operating frequency. The throughpass time is governed by the construction and must be determined by measurements. What is attempted to be attained when selecting the time-constant is that the regulation should be calculated to be rapid enough that it can still immediately counter-regulate the influence of the coins moving quickest through the measuring coil or winding, in other words there does not occur any appreciable change in the amplitude of the no-load oscillator-measuring voltage at the measuring coil, but, on the other hand, not so rapidly that it, as already mentioned, controls or stabilizes the half waves of the non-rectified oscillator-measuring voltage at the inverting input of the differential amplifier.

In contrast to all other already known quasi-static functioning methods the novel methods here proposed are quasi-dynamic and function only in conjunction with a defined speed of movement of the coins and a defined time-constant of the regulation circuit which is tuned thereto. Stationary, too slow moving or too rapidly moving coins, that is to say, coins which move outside of a certain velocity tolerance band, do not produce any evaluatable amplitude (too small or distorted) of the regulation magnitude to be measured.

Further, it is advantageous if the circuit arrangement is constructed such that the circuit components of the differential amplifier bring about a separation of the "long-time regulation magnitude" from the "coin-regulation magnitude", and in the embodiments described hereinafter examples will be given.

It is further advantageous if an additional voltage divider between the timing element determining the time-constant and the input of the regulatable resistor steps-down the regulation magnitude, and thus, brings about that the amplitude of the regulation magnitude at the output of the differential amplifier is correspondingly greater and hence also the amplitude of the regulation magnitude which is employed for the coin checking.

The traveling- or slide track upon which move the coins to be checked can be provided at that place where there bear the coins moving therepast, at a small spacing from the through-passing coins, with one or a number of measuring coils of one or a number of oscillating circuits, so that the coins can pass with their end face the measuring coil or coils. With the particular advantage of increased recognition accuracy it is also possible to enclose the coin chute or channel intended for guiding the coins with one or a number of narrow ring- like measuring coils.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 1A:
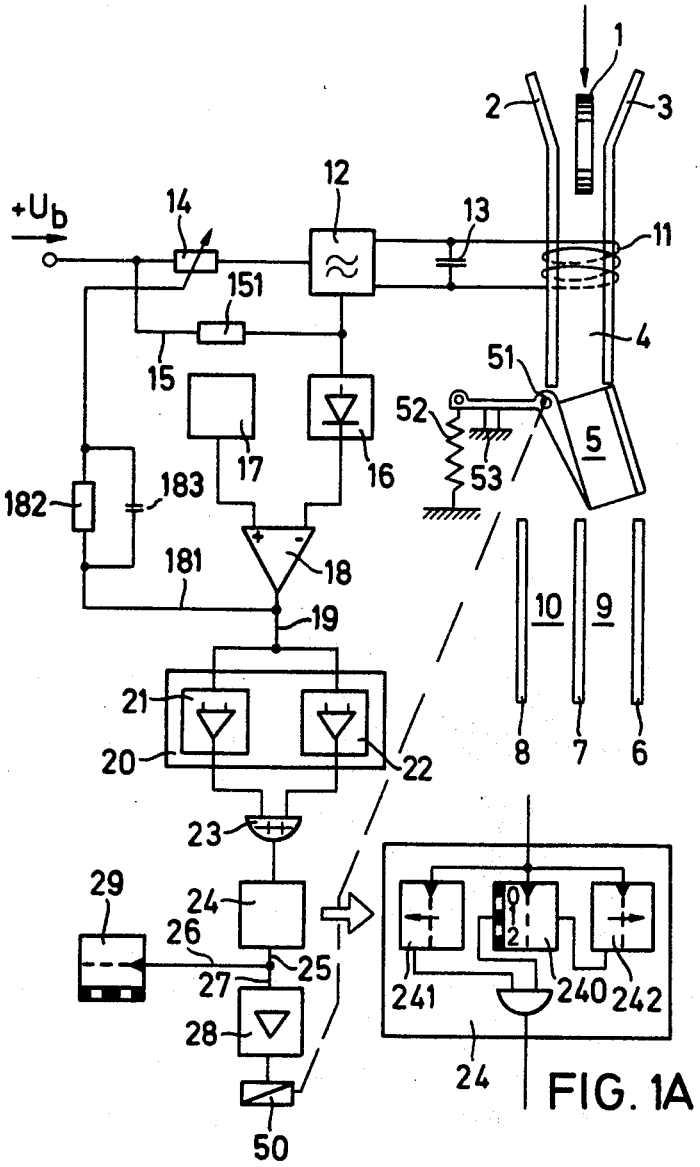
FIG. 1 schematically illustrates a first exemplary embodiment of a coin checking apparatus of the invention.
FIG. 1A illustrates a circuit diagram of the logic circuit used in the arrangement of FIG. 1.

Describing now the drawings, with the coin checking apparatus illustrated in FIG. 1 the coin 1 to be checked is permitted to free fall through a chute or channel 4 formed by the side walls 2 and 3. In the event that the coin 1 is not accepted it is conducted by means of the classification or sorting chute 5 into the return chute 9 formed by the side walls 6 and 7. In the event of coin acceptance the classification or sorting chute 5 is rocked about shaft 51 and thereby conducts the coin 1 into the acceptance chute 10 formed by the side walls 7 and 8.

The classification or sorting chute 5 is retained in rest position by a spring 52 against a stop 53. It is connected with an actuation magnet 50 such that when the latter is energized it causes pivotal or rocking movement of the classification chute 5 over the acceptance chute 10.

Arranged around the drop chute or channel 4 is a coil or winding 11 of a tank circuit consisting of the winding or coil 11 and the frequency-determining element 13 e.g. a capacitor. The control of the oscillator 12 occurs by means of an influencing element, in this instance for example a regulatable or variable resistor 14. Reference character 15 designates the feedback loop or line for stabilization, and reference character 151 the feedback resistor.

In the idling or no-load state there should appear at the coil 11 an oscillator-measuring voltage of a certain value (n-volts), which is tapped-off and rectified in a rectifier 16. The rectified no-load voltage ($U_G$) is delivered to the (rapidly regulating) differential amplifier 18, for instance the commercially available type 741 of Motorola Company, or another suitable amplifier. The second input of the differential amplifier 18 has supplied thereto a reference voltage of *n* volts produced by the reference voltage source 17. In the rest state there is valid the relationship $U_{Ref} = U_G$. Upon passage of the coin through the measuring coil there is valid, slightly time-delayed owing to the regulation or readjustment, likewise the relationship $U_{Ref} = U_G$.

The regulation circuit is connected via the line or conductor 181 with the regulatable resistor 14. There appears at the conductor or line 181 a regulation voltage when the predetermined oscillator no-load voltage appearing at the measuring coil 11 changes. Since, however, the temperature- or long-time effects, which should be controlled or stabilized in this manner, only appear in a creeping or slow manner, in the normal instance this regulation voltage, that is to say, when no coin drops through the measuring coil 11, remains very small and almost equal to null. The time-constant of the regulation circuit is thus determined by the RC-element composed of the resistor 182 and the capacitor 183.

From the circuit arrangement it will be apparent that owing to the continuous stabilization of all conceivable effects upon the oscillating or tank circuit there can be employed very simple and inexpensive components, without losing the desired high temperature-stability. The small number of inexpensive components and the elimination of any tuning work constitute economies of the proposed method.

Now if the coin 1 drops through the field of the measuring coil 11 with an approximately determinable speed and taken into account during calculation of the time-constant of the regulation circuit, then at the output of the differential amplifier 18 there appears at the line 181 a regulation voltage. This regulation voltage becomes that much greater the greater the influence of the coin upon the alternating-current field of the measuring coil 11. This regulation voltage is directly proportional to the change of the field by the coin, since it compensates such and maintains constant the predetermined voltage at the measuring coil 11.

It has already been mentioned that the time-constant of the regulation circuit can be dimensioned to be appropriately large while taking into account the stabilization or control of the oscillator oscillations. On the other hand, it must however be chosen, as a function of the operating frequency and the speed of movement of the coin, to at least be so small that there can occur in any event a counter-regulation. Starting from these boundary magnitudes the time constant must be optimized such that a predetermined maximum influence of the oscillator coil corresponds to a maximum possible proportional regulation magnitude. With coins dropping in a certain coin checking construction there can be for instance, approximately assumed that such move through a distance of 2/10 mm per millisecond. This distance corresponds approximately to the path which is critical for the determination of the maximum influence, i.e. a coin has its maximum influence upon the magnetic field of the oscillator coil at a certain location and still has an influence throughout a distance range of about 1/10 mm in both directions, which approximately corresponds to the absolute maximum. At greater spacing of the coin in each of both directions from its ideal position (i.e. the position where there is brought about the absolute maximum of the influencing effect) the influencing action decreases markedly and becomes increasingly intolerable for carrying out coin checking. The actual measuring operation for a coin located in the mentioned construction thus occurs over a distance of approximately 2/10 mm and within a time period of about 1 millisecond. While observing the selected operating frequency of the oscillator coil the time-constant can be chosen to be so small that the regulation circuit is capable of controlling or stabilizing changes resulting upon passage of the coin through the coil, so that no appreciable change of the amplitude of the HF-no-load voltage at the measuring coil 11 occurs during the fall-through of a coin. As a result, for measuring a dropping coin there must be furthermore chosen a certain minimum frequency if there is to be avoided, to advantage, that the sinusoidal oscillations of the oscillator will be regulated-out or stabilized (something which should not occur).

It is therefore apparent that the proposed novel method for measuring coins does not operate quasi-statically, rather quasi-dynamically and with the aid of an appropriate time-constant: It is thus possible to designate the method as a quasi-dynamic method. If further will be seen that for appropriate dimensioning of the oscillating circuit and the regulation circuit there must be approximately present the speed of movement of the coin, since a time-constant which has been optimumly chosen in consideration of a pronounced regulation magnitude and therefore as good as possible detection of the coin, in the case of a coin which moves too slowly (for instance a coin lowered on a thread into the coin checking device) does not deliver any or only a slightly falsified and weakened signal information. In this way there is achieved the beneficial result that the proposed method for checking coins, in consideration of the security against being deceived by thread tricks, is far superior to all other heretofore known methods, all of which operate statically.

The previously mentioned minimum frequency which must be present at a given speed of movement X of the coins, is lower in the case of a traveling or rolling coin than in the case of a very rapidly moving coin (free fall or rapid mechanical conveying).

The already mentioned regulation voltage is tapped-off at the line or conductor 19 and delivered to an evaluation circuit comprising a window circuit 20 consisting of a lower voltage threshold 21 and an upper voltage threshold 22, which may be as shown, operational amplifiers, but also could be constituted by diodes or transistors. The outputs of both voltage thresholds are connected with an antivalence gate 23, which upon response of only one threshold delivers an output signal and does not deliver any output signal when no voltage threshold is excited or both voltage thresholds are excited. Thus, if the amplitude to be detected of the regulation voltage does not reach the predetermined window range or region, then the subsequently connected logic circuit 24 does not receive any pulse. If the maximum value of the regulation voltage enters the window region, then the logic circuit 24 receives a pulse. If the window region is exceeded at the upper boundary, then the logic circuit 24 receives shortly in succession two pulses: one upon ascent of the regulation voltage into the window region and until leaving the window region at the top, a further pulse upon again entering from above the window region and until leaving the window region at the bottom.

The logic circuit 24 is designed such that upon occurrence of a first pulse a timing device or stage 241 suppresses for a certain time the evaluation of the stored signal or signals and after expiration of such time determines whether there has arrived at the counter 240 one signal or two signals. Only the output 1 of the counter 240 is connected with the output of the timing stage 241 via a gate, so that its output signal can be evaluated by means of the output lines 25/26, for instance for counting the coins. The duration of this output pulse upon the line 25 is determined by the timing element 242, the time of which is greater than that of the timing element or stage 241. The difference of both times determines the duration of the output signal, because the timing element 242 accomplishes by means of the descending flank or slope of its timing signal extinguishing of the counter 240.

By means of the lines 25/27 the output signal is delivered to a driver stage 28 which controls the magnet 50. In the described exemplary embodiment the control times for the magnet 50 and an external counter 29 are the same. If necessary, there can be realized in conventional manner also a different control time for the magnet 50 and the counter 29 in that, for instance, a further counting stage is incorporated into one of both signal lines 26 or 27. The positively directed regulation voltage, which has been described on the basis of the showing of FIG. 1 and employed for evaluation, is for certain coins very small, because also the influence upon the oscillation circuit by the coin, due to its smaller dimensions and its material, in many cases, is only very small. A very small voltage, however, is difficult to detect for reasons of circuit design.

For instance, a very small coin generates, during falling through the measuring coil, a regulation voltage of 50 ± mV so that the spacing between the upper and lower thresholds of a window circuit monitoring the regulation voltage amounts to 4 mV. It should be clear that nothing can be effectively accomplished with such low signal levels if the evaluation circuit is designed with acceptable low component expenditure.

Hence, it is an objective of the invention to obtain, even when the oscillation circuit is slightly influenced by a coin, increased evaluatable amplitudes through the provision of additional measures, so that it is possible to employ simpler and less expensive evaluation circuitry.

The additional proposals therefore relate to two different measures, specifically obtaining an increased sensitivity of the oscillating circuit and therefore a correspondingly greater regulation voltage and/or obtaining a regulation magnitude at the output of the differential amplifier which is greater than the direct proportional relationship for damping of the oscillating circuit.

Therefore, it has been proposed to operate the oscillating circuit at resonance (resonance frequency) in order to make use of the coherent resonance step-up which comes into play due to the measuring coil during throughpassage of a coin.

It is further proposed to supply the positive amplitude of the regulation voltage, resulting from the influence upon the measuring coil tuned to resonance or another random frequency, to the input of the regulator oscillator by means of a voltage divider of a certain ratio so that for the purpose of obtaining a sufficient regulation magnitude at the input of the regulatable oscillator, by means of the differential amplifier in the regulation circuit there is produced an appropriately greater regulation voltage, and thus, there can be tapped-off a greater voltage for evaluation by the evaluation circuit. If, for instance, in order to achieve a certain readjustment at the input of the oscillator, without the use of a voltage divider, there is necessary a regulation amplitude of 50 mV at the output of the differential amplifier, then to achieve the same readjustment at the input of the oscillator, when using an additional voltage divider of 20:1 there is required at the output of the differential amplifier a regulation amplitude of 1 volt, that is to say, there is only available for evaluation by the evaluation circuit a larger regulation magnitude.

According to a further proposal there thus can be delivered to an evaluation circuit regulation amplitudes of such magnitude that there are possible the most simple constructions of voltage-monitoring thresholds. While in the case of very low peaks to be monitored there can be used, for instance, expensive operational amplifiers as the voltage-monitoring thresholds, with correspondingly greater peaks to be monitored a voltage threshold can be easily realized with a simple circuit containing an inexpensive transistor, since its absolute drift always becomes less significant with relative ascending measurement magnitudes.

Figures 2, 2A:
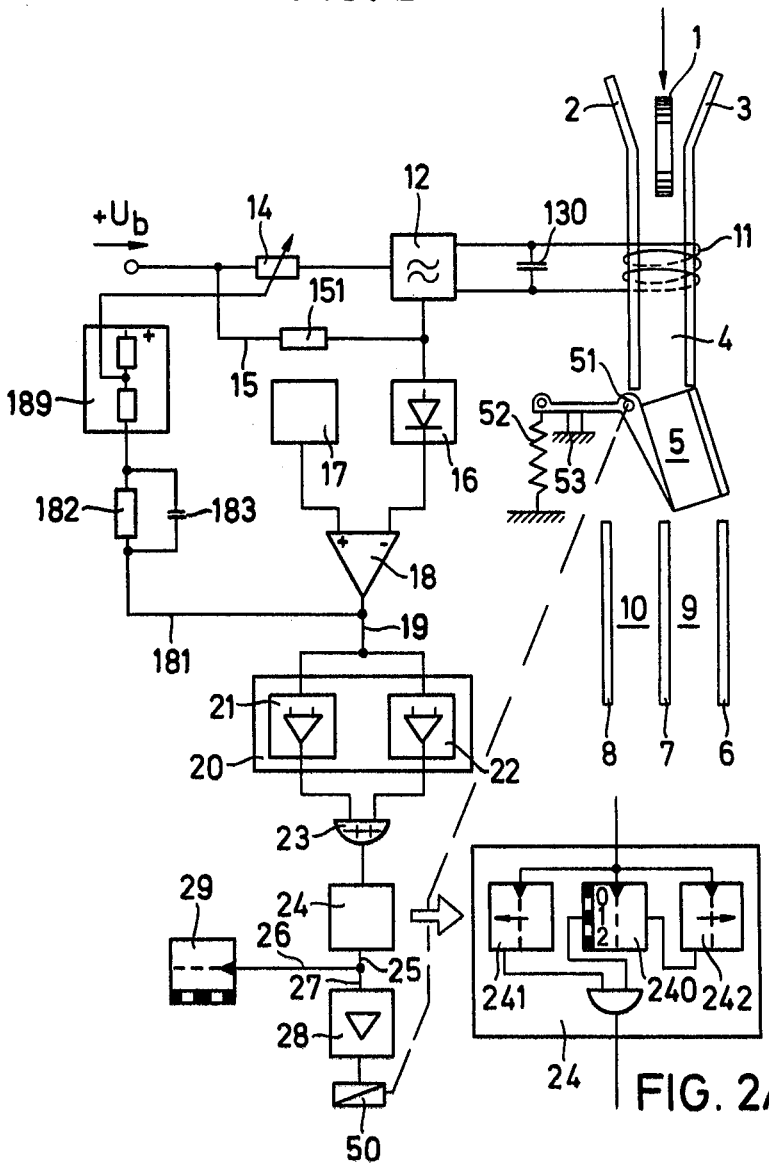
FIG. 2 schematically illustrates a second exemplary embodiment of coin checking apparatus according to the invention.
FIG. 2A illustrates details of the logic circuit used in the arrangement of FIG. 2.

With the exemplary embodiment illustrated in FIG. 2, wherein the same reference characters have been used for the same or analogous components, an oscillator 12 controlled via a regulatable resistor 14 and connected with a measuring coil 11 wound about a coin chute 4 is operated at a resonance frequency governed by the capacitor 130.

The measuring voltage appearing at the oscillating circuit is tapped-off, rectified in a rectifier 16 and delivered to a differential amplifier 18, at the second input of which there is applied a fixed predetermined reference voltage furnished by the reference voltage source 17. The reference voltage corresponds to the rectified no-load oscillator measuring voltage at the output of the rectifier 16 and the differential amplifier 18 immediately stabilizes or regulates-out by counter-regulation the appearing differential voltage in that it introduces an appropriate regulation magnitude on the line 181. The regulation voltage at the regulatable resistor 14 must correspond to the degree of the influencing action or effect which a coin 1, upon dropping through the measuring coil 11, exerts upon the oscillating circuit.

The exemplary embodiment illustrated in FIG. 2, in contrast to FIG. 1, has a voltage divider 189 additionally incorporated into the regulation line 181 which steps-down the regulation voltage in a certain ratio and thus requires that there must be delivered a correspondingly greater voltage by the differential amplifier 18 if there is to be obtained the voltage needed for the regulation at the output of the regulatable resistor 14.

As stated with regard to the discussion of FIG. 1, the regulation magnitude generated by the coin should be measured and which magnitude is directly proportional to the influence of the oscillation circuit-amplitude by the coin. When in toto there are present stable conditions in the circuit and not too great a temperature range, then the circuit of FIG. 1 or 2 can be employed, because, in the normal instance, the regulation magnitude almost exclusively expresses the influence upon the oscillation circuit-amplitude by the coin, and the proportion, which continually is present for stabilizing the drift or the like, is so small that the coin measurement does not appreciably suffer in accuracy. This, however, requires care in selecting the time-constants. Such can, however, already cause difficulties if the speed of movement of the coins varies slightly.

Figure 4:
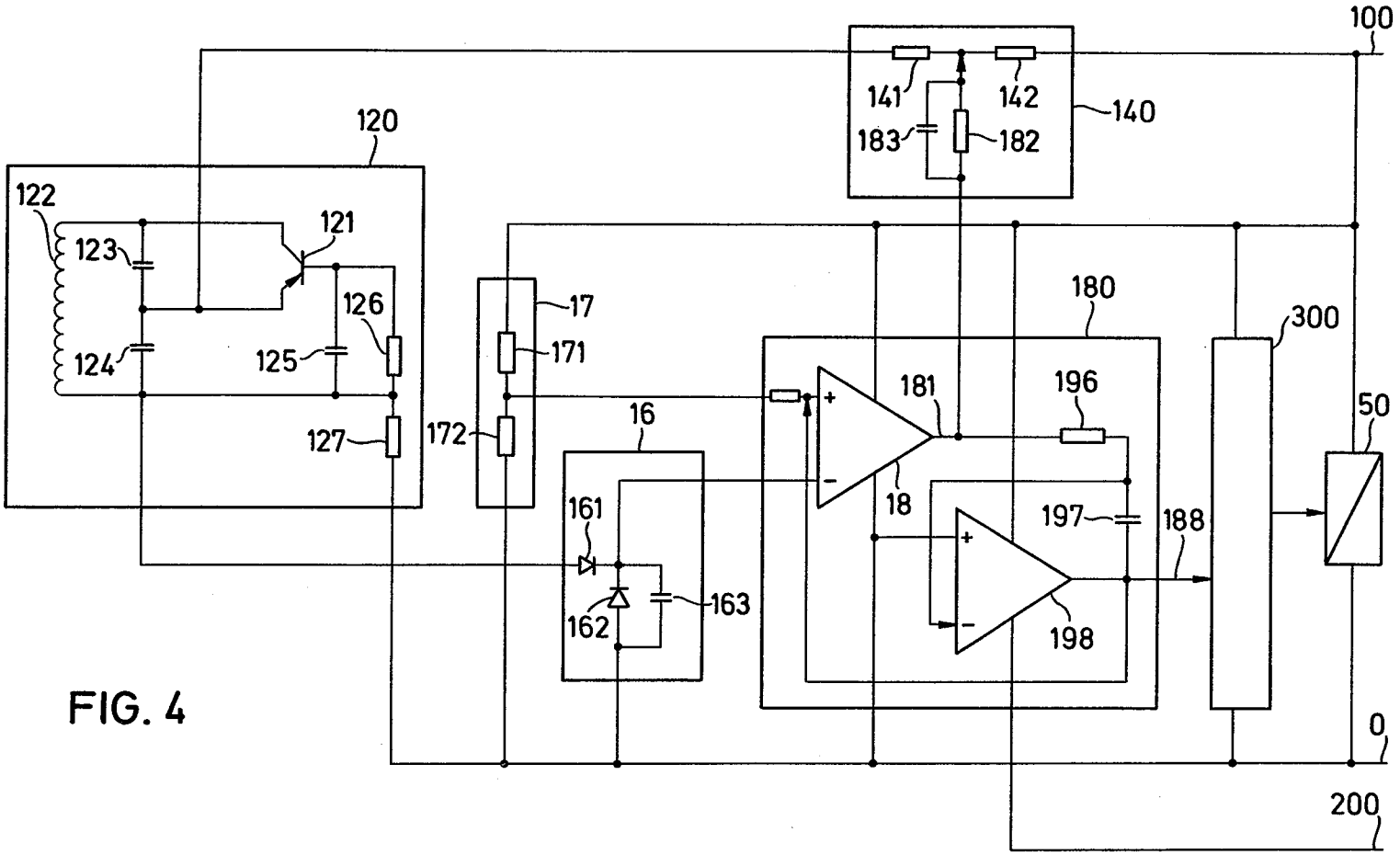
FIG. 4 is an electrical circuit diagram of a fourth exemplary embodiment of the coin checking apparatus of the invention.
Figure 5:
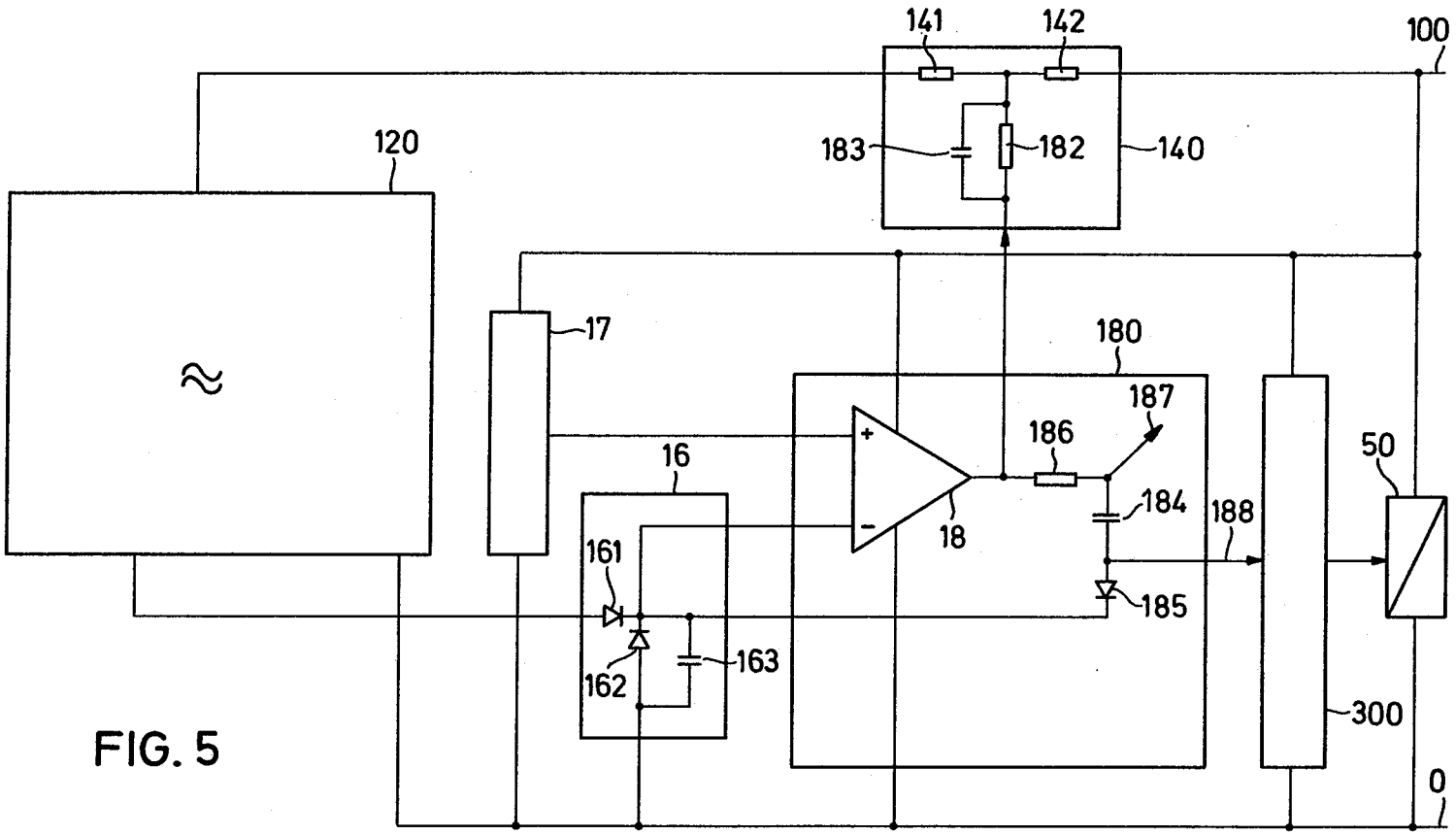
FIG. 5 is an electrical circuit diagram of a fifth exem plary embodiment of a coin checking apparatus of th invention.

Also, in those instances where there are employed extremely inexpensive components for the purpose of reducing fabrication costs and all temperature stabilization expenditure is avoided or where there is taken into account a large temperature range, then the circuitry of FIGS. 1 or 2 can become much too inaccurate, because that portion of the regulation magnitude which serves for stabilization or controlling the long-time influences reaches a considerable portion, and accordingly, increasingly reduces the accuracy of the coin measurement. With appropriate circuit design of the differential amplifier 18 it is, however, possible to achieve the result that the regulation magnitude, brought about by the coin and corresponding to its influence upon the oscillating circuit, can be measured independently of that regulation magnitude which might prevail with an undetermined magnitude for stabilizing slow-type appearing or creeping influences. The subsequently described circuits of FIGS. 3, 4 and 5 thus relate to exemplary embodiments which disclose how it is possible to more advantageously design the circuitry of the regulation circuit 180. Further modifications can be realized according to known principles of circuit design. In FIGS. 4 and 5 certain of the components, corresponding to those of FIGS. 1 to 3, have been designated by the same reference character followed by the digit "0".

The separation of the "coin-regulation magnitude" from the "long-time regulation magnitude" is thereby possible if there is utilized their different time behavior; long-time or long duration influences appear slowly, the coin-influences appear relatively rapidly as already previously described.

It is possible to proceed in two different ways:

(a) There can be employed a circuit which stabilizes or controls the long-time regulation magnitudes which appear slowly, so that the rapidly appearing coin-regulation magnitudes always can be measured from (approximately) null (FIG. 4).

Figures 3, 3A:
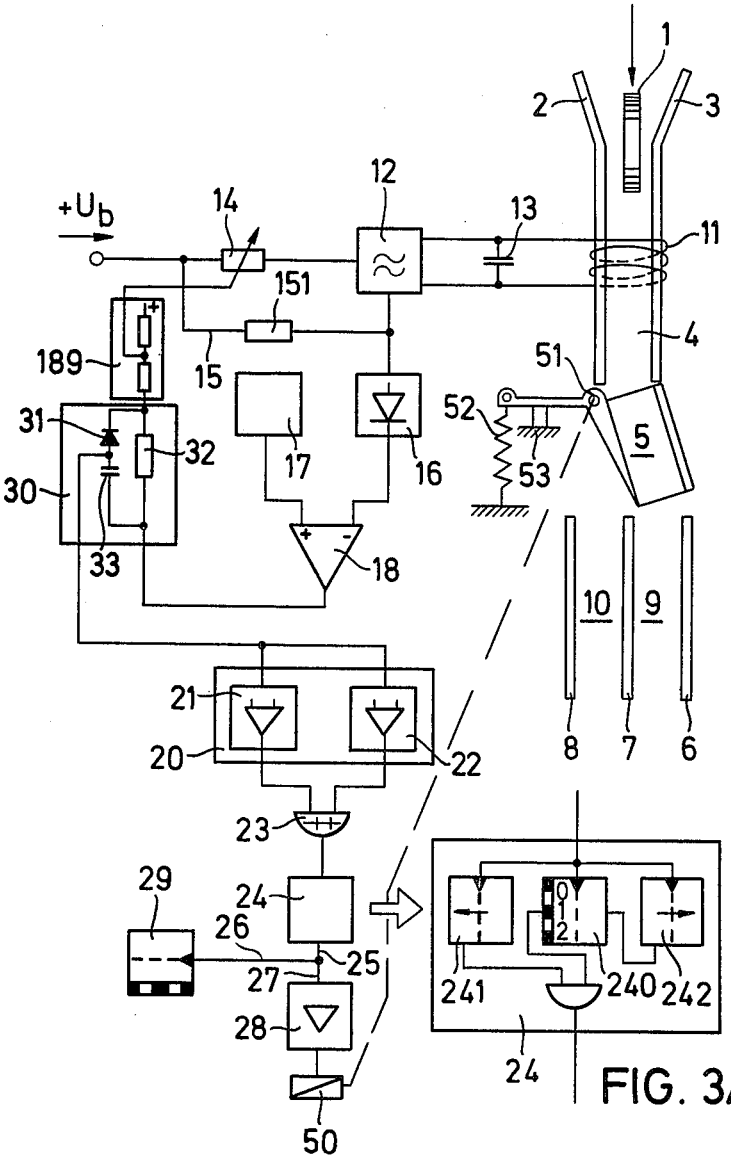
FIG. 3 illustrates a third exemplary embodiment of the electrical circuitry of a coin checking apparatus of the invention.
FIG. 3A illustrates details of the logic circuit used in the arrangement of FIG. 3.

(b) There can be used a circuit which cannot detect slow appearing long-time regulation magnitudes, but however detects the rapid appearing coin-regulation magnitudes (FIGS. 3 and 5).

The solution of the first circuit function (FIG. 4) consists of, for instnace, providing an additional coupling from the output of the differential amplifier 18 to one of its inputs via a null value-comparator circuit connected as an integrator. This comparator insures that the output regulation magnitude of the differential amplifier 18 is fedback or positively fedback at one of its two inputs and thus there is eliminated the voltage difference at both inputs.

At which of the inputs the integrator is coupled, depends upon the polarity of the integrator-output voltage: with negative output voltage of the integrator the reference voltage is artifically lowered (this possibility is illustrated in FIG. 4), with positive output voltage of the integrator the measurement voltage is artifically increased. In both instances the output regulation magnitude of the differential amplifier 18 becomes null.

The solution of the second circuit function (FIGS. 3 or 5) consists of, for instance, in either a "dynamic forward loop or coupling" from the measuring voltage input of the differential amplifier 18 to its output (FIG. 5) or, for instance, in a "dynamic feedback loop or coupling" from the output of the differential amplifier 18 to the input of the influencing element 14 at the input of the oscillator-tank circuit (FIG. 3). In contrast to known forward coupling circuits the "dynamic forward coupling-circuit" disclosed in FIG. 5 advantageously consists of a diode 185, a capacitor 184 and a resistor 186 connected in series. The diode 185 during low peaks blocks the current flow from the measuring voltage input of the differential amplifier 18 to the capacitor 184 and the resistor 186 serves as a charging- and discharging-resistor for the capacitor 184 to the output of the differential amplifier 18 and also determines the time-constant.

What is common to the embodiments of FIGS. 4 and 5 is that the time-constant for the feedback or the forward coupling at the differential amplifier input is greater than the time-constant for the feeback at the influencing element 140 (or 14) at the input of the oscillator-tank circuit.

In contrast to the feedback circuitry described in FIG. 1, the "dynamic" feedback circuit illustrated in FIG. 3 is constituted, according to the invention, by a capacitor 33 and a diode 31 connected in series, and in parallel thereto a resistor 32. Advantageously, the capacitor 33 is connected with the output of the differential amplifier 18 and thus, the diode 31 is poled towards the input of the oscillator 12. The remaining reference characters designate components corresponding to those of FIG. 1.

Moreover, the embodiment of FIG. 3 has the advantage that calculation of the time-constants for the "dynamic" feedback is considerably less critical than that of the time-constants for the feedback according to FIG. 1.

Thus, it is possible to define the described improvements also as "regulation circuit with two feedback couplings or loops" (FIG. 4) or "regulation circuit with a feedback coupling or loop and a forward coupling or loop" (FIG. 5) or "regulation circuit with a dynamic feedback loop or coupling" (FIG. 3). The mode of operation of the three examples of circuit connecting the differential amplifier 18 will be described hereinafter.

At this point it is mentioned the operating point of the amplifying transistor e.g. the transistor 121 (see FIGS. 4 and 6) of the oscillator 12 is located along the steep portion of the resonance curve in order to obtain increased sensitivity of the oscillating or tank circuit when influenced by a coin, and thus, to obtain increased recognition accuracy.

Also in this case there is formed a regulation magnitude from the difference of the reference voltage and the rectified measurement or measuring voltage at the input of the differential amplifier 18, which regulation magnitude, in the ideal case, during no load, is equal to null.

With slow changes of the coincidence of $U_{Ref}$ and $U_G$ due to drift or the like, there arises a modified no-load regulation magnitude of uncertain but low magnitude which readjusts the oscillator by means of the resistor 32, the voltage divider 189 and the influencing element 14. Since the diode 31 blocks, the capacitor 33 cannot charge with slow and slight changes of the regulation magnitude. An approximately continuously prevailing long-time regulation magnitude thus does not reach the capacitor and the tap for the measuring voltage for the coin evaluation.

In the case of more rapid and pronounced changes of the regulation magnitude, such as upon passage of a coin through the measuring coil 11, there appears at the output of the differential amplifier 18, also at the input of the dynamic feedback circuit 30, a greater voltage than at the output of the dynamic feedback circuit. Since the diode 31 functions as a pole-dependent current valve, the capacitor 33 can suddenly charge. Its charging voltage corresponds to the increase of the regulation magnitude, which has been brought about by the coin, and therefore can be tapped-off as the measurement magnitude between the capacitor 33 and the diode 31 for the evaluation of the coin.

In contrast to the circuitry of FIG. 1 the circuitry of FIG. 3 has the further advantage that it is more suitable for mass production. As already mentioned, the dimensioning of the optimum time-constants for the circuit of FIG. 1 is critical and therefore in this case there must be employed components (resistor and capacitor) which have been fabricated within narrow tolerances or must be tuned thereto. Owing to the separation of the long-time regulation magnitude from the coin-regulation magnitude, due to the blocking action of the diode as above described, the dimensioning of the optimum time-constants for the dynamic feedback is less critical, and can be realized without tuning with normal, i.e. inexpensive components.

Due to the separation of the long-time regulation magnitudes and the coin-regulation magnitudes it is further possible, in contrast to the example of FIG. 1, also to dispense with tuning of the reference voltage or the HF-measuring voltage. In FIG. 1 it was necessary to have exactly in coincidence the reference voltage and the rectified measuring voltage, in order to obtain for no-load a regulation magnitude of null, and thus, to achieve as small as possible long time-regulation magnitude for stabilizing possible drifts. With the embodiment of FIG. 3 it is sufficient if the reference voltage is not less than the rectified measuring voltage. This can be however, easily achieved with standard components if the reference voltage is calculated to be slightly larger than the rectified oscillation-measuring voltage. This indeed does result in the differential amplifier 18 continually producing a regulation magnitude of uncertain value already under no-load condition. Since, however, with the embodiment of FIG. 3 the long time-regulation magnitude does not have any disturbing effect within a certain range, this does not have any influence upon the accuracy of the coin measurement, rather only brings the considerable advantage of eliminating any type of tuning work.

During the discussion of FIG. 1 it was previously mentioned that in the ideal case the no-load regulation magnitude is equal to null and must be equal to null.

If according to the proposed invention the circuit is designed such that there occurs a separation of the "long-time regulation magnitude" from the "coin-regulation magnitude", then this requirement is no longer applicable. With the embodiment of FIG. 3 the differential amplifier 18 can be also readily operated with only one positive supply voltage. Yet, the control of a differential amplifier, due to its construction, only then first occurs after a certain voltage difference prevails at its inputs, because the "minimum voltage at the output" has a certain value (e.g. 2.5 volts) when the differential amplifier is operated with only one supply voltage. According to the proposed invention it is readily possible to select the reference voltage that much greater than the non-readjusted, rectified oscillator-measurement voltage so that the differential amplifier, in the case of no-load continuously must supply a certain regulation magnitude (for instance 4 volts), in order to maintain in coincidence the values of $U_G$ and $U_{Ref}$.

The dynamic feedback ensures that also such relatively high no-load regulation magnitude does not result in charging of the capacitor 33 and that it will not be detected by the evaluation circuit 20.

There only will be detected a rapid voltage rise or ascent past the no-load peak. Also, in this case there will only be evaluated the regulation magnitude caused when a coin drops through the alternating-current field of an oscillator-measuring coil, and specifically, in this case the difference between a no-load regulation magnitude which prevails for a long time and a voltage maximum which suddenly appears due to the influence of the coin.

The same advantage of simpler and less expensive fabrication for mass production without any tuning work exists with the circuit embodiments of FIGS. 4 and 5, wherein such advantages however are merely achieved in a different manner as will be explained hereinafter.

In FIG. 4 there are again disclosed the individual function blocks appearing in FIG. 1 and here described in greater detail. The supply voltage is designated by reference character 100, the negative supply voltage by reference character 200, ground is designated by reference numeral 0. Reference character 120 designates the oscillator which corresponds to the components 11, 12, 13 and 151 of FIG. 1. In the example of FIGS. 4 and 5 there is shown a conventional capacitive three-point oscillator, arranged in an emitter circuit configuration consisting of the transistor 121, the coil 122 and the capacitors 123, 124 and 125. The capacitor 124 determines the oscillating frequency, the capacitor 125 serves for feedback, the capacitors 123 and 125, in conjunction with the resistors 126 and 127, determine the operating point which is centrally located. Owing to the foregoing the differential amplifier 18 can detect voltage deviations of the rectified oscillator measuring amplitude.

The control of the oscillator 120 occurs with a predetermined selected operating voltage by means of the influencing element 140 (consisting of the resistors 141, 142 and 182 and capacitor 183) by means of which the oscillator oscillates at a predetermined HF-amplitude. The thus obtained HF-voltage is rectified in the rectifier 16 consisting of the diodes 161 and 162, filtered by means of the filtering capacitor 163 and delivered to the inverting input of the differential amplifier 18. The reference voltage is obtained by means of the reference voltage source e.g. the voltage divider 17 consisting of the resistors 171 and 172. It is here again mentioned that all of the illustrated solutions are only intended as exemplary and are not in any way intended to limit the scope of the invention. For instance, instead of obtaining the reference voltage by means of a voltage divider from the supply voltage, this reference voltage of course also could be obtained from a fixed voltage source, such as the source 17 of FIG. 1, or by means of a reference diode or in any other randomly selected manner. The manner of obtaining the reference voltage as indicated by way of example from the supply voltage is always then possible if the operating point of the oscillator and the reference voltage are located in the same relationship, since only then is there realized an extensive non-dependency of the measuring accuracy from fluctuations of the supply voltage. The operating points should not shift.

Also, a free selection of the oscillator is possible as long as such delivers an output amplitude which is in a fixed relationship to the applied supply voltage. Thus, there could be equally employed, for instance, an oscillator designed as a Meissner-circuit or a Cholpitz-circuit, a quartz oscillator or any other suitable oscillator.

In order to preserve clarity in illustration the function blocks 20, 23, 24, 28 and 29 of FIG. 1, in other words the entire signal evaluation, have been illustrated in corresponding manner in FIG. 4 simply as the function block 300, and the classification or sorting magnet has been indicated by reference character 50. Only the external circuitry of the differential amplifier 18 for separately obtaining the coin-regulation magnitude determined solely by the coins has been individually illustrated in FIGS. 4 and 5.

Both examples insure that the coin regulation magnitude, brought about by the action of the coins, is measured independently of any possibly prevailing long-time regulation magnitude. Other examples are possible while taking into account the described concepts of the invention, for instance by utilizing the base-emitter voltage of a transistor.

In FIG. 4 the output regulation voltage of the differential amplifier 18 is delivered via the conductor or line 181 and a resistor 196 to the inverting input of a comparator 198, the other input of which is at ground potential. The comparator 198 continuously compares the infed positive output regulation voltage of the differential amplifier 18 with null and in turn delivers a negative regulation voltage. The latter is supplied to the non-inverting input of the differential amplifier 18 (equal to the reference voltage input) and thus terminates the non-coincidence of both input voltages, in other words eliminates the regulation or control of the differential amplifier 18. In order to render perceivable the rapid changes of the regulation voltage during passage of a coin the comparator 198 must be designed as an integrator, and the time-constant of the capacitor 197 and the resistor 196 chosen such that it is slower than that of the feedback coupling at the input of the oscillator via the influencing element 140.

The circuit thus operates in the manner that the output regulation voltage of the differential amplifier 18 through the integrator in the feedback loop at the input of the differential amplifier 18 is employed for correcting the reference voltage with slow changes and is terminated by correction of the reference voltage. The long-time regulation magnitude is thus always led to the value null, so that in the case of a coin measurement the rapid changes of the regulation magnitude, brought about by the action of a coin, can be separately tapped-off. The here described circuit fulfills the greatest requirements in accuracy and stability. The only drawback is the requirement for two supply voltages and two operational amplifiers 18 and 198.

Now in FIG. 5 there is illustrated an embodiment of circuitry which can function with a single supply voltage and wherein the circuitry of the differential amplifier 18 requires neither a further operational amplifier nor an additional transistor or the like.

The already mentioned dynamic forward coupling or loop contains a capacitor 184 which cannot charge with slow changes of the regulation voltage at the output of the differential amplifier 18, because the diode 185 blocks at the higher peak. If during the coin measurement the measuring voltage at the input of the differential amplifier 18 drops, then the regulation voltage at the output of the differential amplifier increases, and indeed considerably owing to the gain of the differential amplifier 18. Between both points there forms over the forward coupling line or loop a voltage gradient which leads to elimination of the blocking of the diode, and thus, to a sudden charging of the capacitor 184 because the resistor 186, which for small peaks brings about a pronounced charging delay, now is no longer effective. The charging continues as long as the voltage climbs and transforms into a discharge via the resistor 186 towards the output of the differential amplifier 18 when the voltage drop reduces. Since these operations are determined by the speed of movement of the coins, the time-constant of the forward coupling is derived from the speed of movement of the coin, tuned to such and in any event slower than the time-constant of the feedback to the input of the oscillator via the influencing element 140. At the tap 187, better still at the tap 188 there can be tapped-off a dynamic signal, which only expresses those voltage increases which rapidly proceed, in other words emanate from a normally moving coin.

The influencing element designated by reference character 140 in FIGS. 4 and 5 contains in conventional manner, by appropriate dimensioning, the components of the timing element for the feedback (182 and 183 of FIG. 1), the voltage divider (189 of FIG. 3) and the influencing element designated by reference character 14 in FIG. 1. In the same manner it could also be constructed such that instead of the timing element for the feedback loop it contains a timing element for the dynamic feedback.

In FIGS. 4 and 5, it being specifically shown in FIG. 4, the measuring coil 122 is a component of the oscillator 120.

Figure 6:
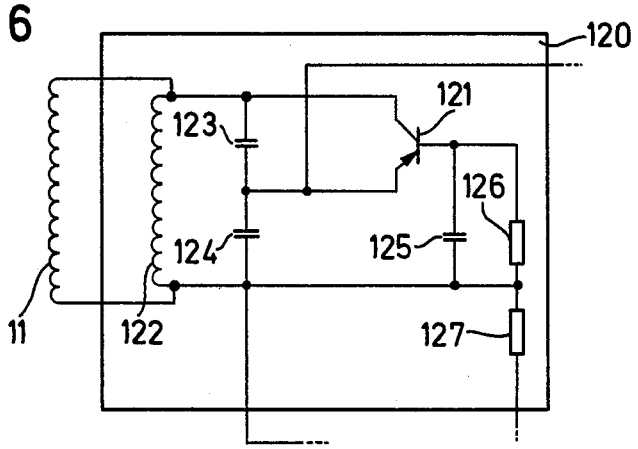
FIG. 6 illustrates a circuit diagram of a galvanically coupled coil as the measuring coil.

In FIG. 6 there is illustrated a circuit arrangement wherein the measuring coil 11 is galvanically coupled with the oscillator 120 which, it will be seen, is constructed in the manner described above in conjunction with FIG. 4 and therefore the same reference characters have been used for the same components.

Figure 7:
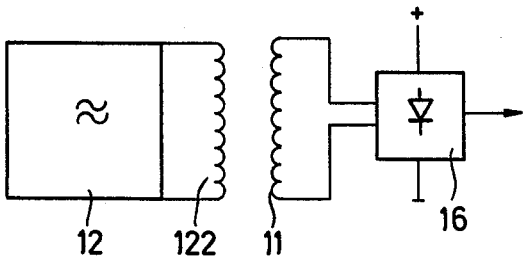
FIG. 7 is a circuit diagram illustrating a transformer-coupled coil as the measuring coil.

In FIG. 7 there is illustrated the transformer-coupling of the measuring coil 11 with the coil 122 of oscillator 12, so that the coils 122 and 11 form a tranformer.

Figure 8:
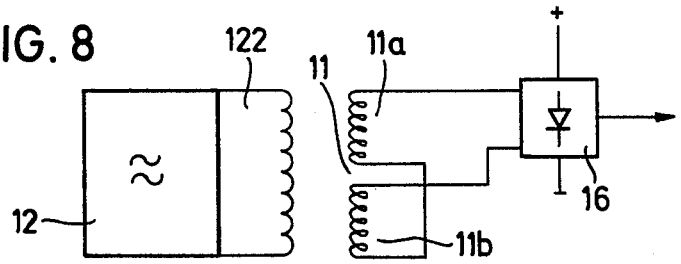
FIG. 8 illustrates a circuit diagram of a transformer-coupled, out-of-phase pair of coils of a differential transformer serving as the measuring coil.

In FIG. 8 the out-of-phase, series connected coils or windings 11*a* and 11*b* form the measuring coil 11 which is transformer-coupled with the coil 122 of an oscillator 12, and the coils 122 and 11 form a differential transformer.

Figure 10:
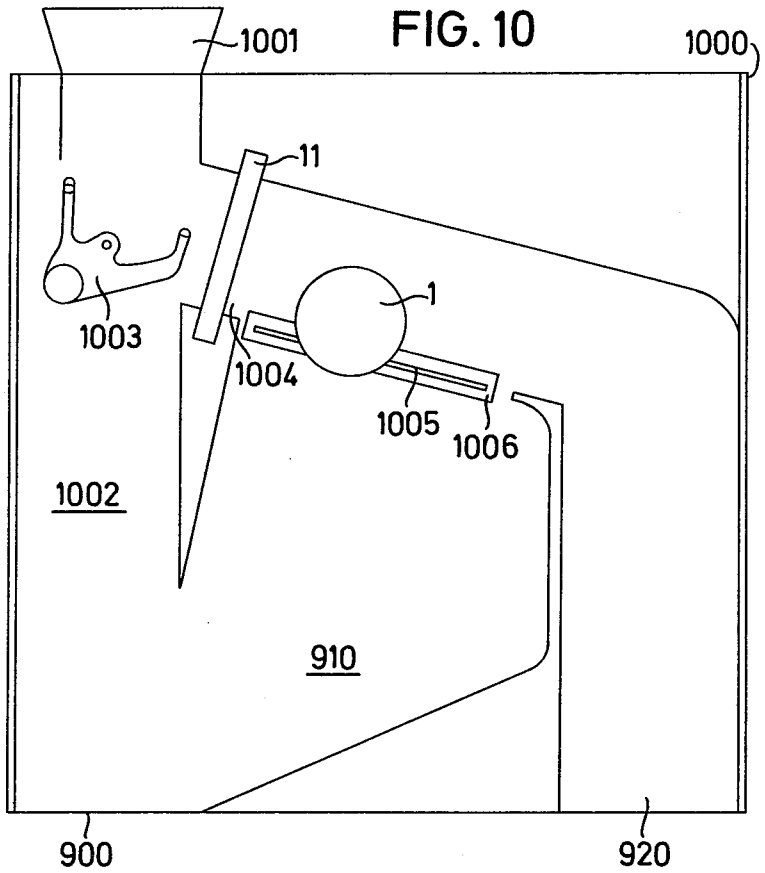
FIG. 10 is a further exemplary embodiment of the construction of a coin channel of a coin checking apparatus.
Figure 9:
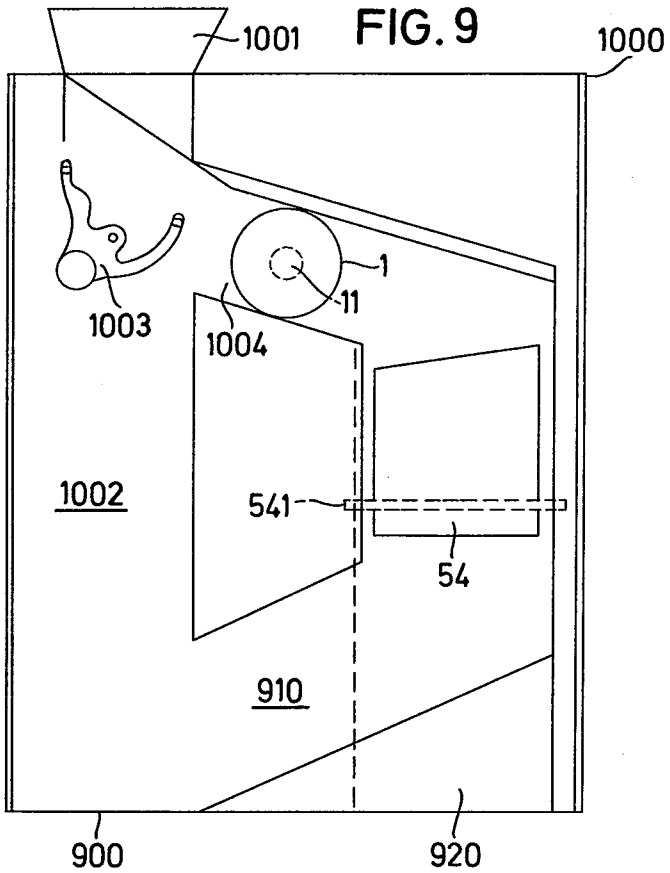
FIG. 9 is an exemplary embodiment of the construction of a coin channel of a coin checking apparatus.

In FIGS. 9 and 10 there is illustrated a coin checking apparatus designated by reference character 1000, its infeed funnel for the coins by reference character 1001, the drop channel situated therebelow and following the infeed funnel 1001 by reference character 1002. A coin balance 1003 of known construction permits coins which are too small to fall down into the outlet 900 (coins which have not been accepted). Coins of the permissible diameter are laterally tilted away by the coin balance 1003 into a traveling chute or track 1004. Coins of too large diameter block and can be conveyed by a not particularly illustrated unlocking device into the outlet 900.

In FIG. 9 the travel path or track 1004 intended for the coins is inclined slightly laterally, so that a coin 1 can slide past, while in contact with a side wall of the traveling path or track 1004, and thus has a defined spacing from the coil 11, constructed as an end probe, of a tank circuit-oscillator or equivalent means which, in turn, is connected with a coin checking circuit. A classification or sorting flap 54 remains in rest position in the event of a false measuring result, so that the coin slides over the front side of the sorting flap 54 into the chute 910 which terminates at the chute 900 for non-accepted coins.

In the case of proper measurement results the magnet 50 of FIGS. 1 to 5, but not here shown to simplify the illustration moves the pivotal sorting flap 54 about its shaft 541, so that the coin can arrive at the chute 920 for accepted coins and which chute starts at the rear side of the sorting flap.

In FIG. 10 the travel track 1004 for the coins is surrounded in a ring-like manner by a coil 11 of a tank circuit, oscillator or equivalent means which, in turn, is connected with a coin checking circuit. A horizontally pivoting guide member 1005 remains in its rest position in the event of false measurement results, so that the coin can arrive in the chute 910 and from such into the chute 900 for non-accepted coins. In the case of correct measurement results the magnet 50 of FIGS. 1 to 5 moves the horizontal pivotable guide member 1005 into the recess 1006 of the side wall to such an extent that the coin is hindered from dropping and can roll into the chute 920 for accepted coins and beginning at the extension of the travel track 1004.

Hence, there can be also realized multitype-coin checkers which, starting with the largest coins, exhibit a number of checking apparatuses, of which each one has a coin balance 1003, a coin travel track 1004 with the coil 11 and a coin checking circuit, a magnet 50 with the sorting or classification element 54 or 55 respectively, and an acceptance chute for proper coins which merges therewith.

While there are shown and described present preferred embodiments of the invention, it is to be distinctly understood that the invention is not limited thereto, but may be otherwise variously embodied and practiced within the scope of the following claims.

Accordingly, what is claimed is:

1. A method of checking coins comprising the steps of: moving each coin to be checked through a constantly regulated alternating-current field of a measuring coil cooperating with an oscillator, influencing the alternating-current field by the coin to thereby form an oscillator-measuring voltage, rectifying the oscillator-measuring voltage, forming a regulation magnitude from the difference between a reference voltage and the rectified oscillator-measuring voltage, utilizing the regulation magnitude to readjust, by means of a feedback regulation circuit having a time constant and the oscillator, the oscillator-measuring voltage at the measuring coil to a constant value, employing the regulation magnitude as coin checking criterion during checking of a coin in a manner such that there is determined by means of an evaluation circuit whether such regulation magnitude has reached a value located within an upper boundary and a lower boundary, and selecting the time-constant of the regulation circuit such that there can be stabilized slow changes and the feedback regulation of the oscillator occurs sufficiently rapidly that no appreciable change occurs in the oscillator-measuring voltage so that the oscillator-measuring voltage is maintained constant when the coin moves relatively rapidly through the measuring coil and there is obtained as great as possible amplitude of the regulation magnitude for coin checking.

2. The method as defined in claim 1, including the step of employing an oscillator coil of the oscillator simultaneously as said measuring coil.

3. The method as defined in claim 1, including the step of utilizing as the measuring coil a coil which is galvanically coupled with the oscillator coil.

4. The method as defined in claim 1, including the step of utilizing as the measuring coil a transformer-coupled secondary coil of a transformer.

5. The method as defined in claim 1, including the step of utilizing as the measuring coil an out-of-phase series connected, pair of secondary windings of a differential transformer.

6. A method of checking coins comprising the steps of: moving each coin to be checked through a constantly regulated alternating-current field of a measuring coil cooperating with an oscillator, influencing the alternating-current field by the coin to thereby form an oscillator-measuring voltage, rectifying the oscillator-measuring voltage, forming, in a regulation circuit having a time constant, a feedback regulation magnitude from the difference between a reference voltage and the rectified oscillator-measuring voltage, utilizing the feedback regulation magnitude to readjust the oscillator-measuring voltage appearing at the measuring coil to a constant value, employing the feedback regulation magnitude as coin checking criterion during checking of the coin by determining whether such regulation magnitude has reached a value located within an upper boundary and a lower boundary, selecting the time-constant of the regulation circuit such that there can be regulated-out slow changes and the feedback regulation of the oscillator occurs sufficiently rapidly that no appreciable change occurs in the oscillator-measuring voltage so that the oscillator-measuring voltage is maintained constant when the coin moves relatively rapidly through the measuring coil and there is formed a relatively high amplitude of the regulation magnitude for the coin checking.

7. A coin checking apparatus comprising a circuit arrangement containing an oscillator operating at a predetermined frequency, a measuring coil provided for said oscillator, an influencing element for controlling the oscillator, the oscillator having an input and being influenced by a regulation magnitude delivered by the influencing element to said input such that the oscillator amplitude is regulatable without distortion in accordance with the regulation amplitude at the input of the oscillator, the oscillator including an oscillator circuit containing an amplification transistor, means for supplying a predetermined reference voltage for fixing the operating point of the amplification transistor of the oscillator circuit, a rectifier for rectifying an oscillator-measuring voltage tapped-off the measuring coil, a differential amplifier for forming the regulation magnitude from the difference of the rectified oscillator-measuring voltage and the reference voltage, a feedback loop leading to the input of the oscillator and having a timing element possessing a defined time-constant, the differential amplifier influencing by means of the feedback loop and the influencing element the oscillator such that the rectified oscillator-measuring voltage and the reference voltage substantially coincide, an evaluation circuit for comparing the regulation magnitude of the differential amplifier brought about by the influence of the coin upon the alternating-current field of the measuring coil with a predetermined potential window possessing a lower threshold value and an upper threshold value and accepting the coin when the amplitude of the regulation magnitude is located within the potential window, the time-constant of the timing element of the feedback loop and the differential amplifier is of sufficient magnitude that there does not occur any stabilizing of the half-waves of a non-rectified oscillator-measuring voltage but on the other hand so short that even when receiving as large as possible amplitude of the regulation magnitude as the criterion for the coin checking there does not occur any appreciable change of the oscillator-measuring voltage at the measuring coil during rapid throughpass of a coin.

8. The apparatus as defined in claim 7, wherein the predetermined reference voltage for fixing the operating point of the transistor is a fixed reference voltage.

9. The apparatus as defined in claim 7, wherein the means for supplying the predetermined reference voltage for fixing the operating point of the transistor comprises circuitry for obtaining a reference voltage by voltage dividing an operating voltage, said reference voltage, upon change of said operating voltage, influences the position of the operating point of the amplification transistor in the oscillator circuit such that the no-load oscillator-measuring voltage of the oscillator and the reference voltage, irrespective of the magnitude, always have the same relative relationship to one another.

10. The apparatus as defined in claim 7, comprising a circuit arrangement containing a number of oscillators, the respective oscillator frequency of each of which are slightly detuned with respect to one another to prevent such oscillators from mutually influencing one another.

11. The apparatus as defined in claim 7, comprising a circuit arrangement provided with a plurality of oscillators for obtaining different measurement information, and wherein the oscillator frequency of the respective oscillators are clearly different from one another.

12. The apparatus as defined in claim 7, wherein the circuit arrangement is constructed such that the oscillator is operated at a steep part of its resonance curve and thus with a predetermined influencing of the alternating-current field by a coin brings about maximum change of the oscillator-measuring voltage and thus also maximum amplitude of the regulation magnitude employed for coin checking.

13. The apparatus as defined in claim 7, further including guide means for the coins to be checked, said measuring coil comprising at least one measuring coil of an oscillator-tank circuit operatively associated with the coin guide means, a classification switch for the coins operated by the circuit arrangement, the coin guide means comprising track means upon which travel the coins, said at least one measuring coil of the oscillator-tank circuit being arranged at a location of the track means at which the coins are supported and move past the measuring coil at the smallest spacing therefrom.

14. The apparatus as defined in claim 7, further including a mechanical coin classification device which checks the coins with respect to their dimensions, a coin guide, the coin classification device conducting coins of an acceptable dimension into the coin guide, and said measuring coil comprising at least one measuring coil of the oscillator-tank circuit operatively associated with the coin guide.

15. The apparatus as defined in claim 7, wherein the measuring coil comprises an oscillator coil of the oscillator.

16. The apparatus as defined in claim 7, wherein the measuring coil comprises a coil which is galvanically coupled with an oscillator coil of said oscillator.

17. The apparatus as defined in claim 7, wherein the measuring coil comprises a transformer-coupled secondary coil of a transformer.

18. The apparatus as defined in claim 7, wherein the measuring coil comprises an out-of-phase series connected, pair of secondary windings of a differential transformer.

19. The apparatus as defined in claim 7, further including guide means for the coins to be checked, said measuring coil comprising at least one measuring coil of an oscillator-tank circuit operatively associated with the coin guide means, a classification switch for the coins operated by the circuit arrangement, the coin guide means comprising a chute, said chute being surrounded in a substantially ring-shaped manner by said at least one measuring coil of the oscillator-tank circuit.

20. The apparatus as defined in claim 19, wherein the chute extends in a direction other than the horizontal.

21. A method of checking coins comprising the steps of: passing the coins through an alternating electromagnetic field of a measuring coil energised by an alternating signal, comparing the amplitude of the alternating signal with a reference signal to produce a correction signal whose level is dependent on the difference between the alternating signal and the reference signal, controlling the amplitude of the alternating signal with the correction signal so as to maintain said amplitude substantially constant, and determining whether the level of the correction signal is between upper and lower limits which define a range of levels produced by acceptable coins.

22. The method as defined in claim 21, in which the alternating signal is rectified and applied to one input of a differential amplifier, another input of which receives the reference signal, the differential amplifier providing the correction signal at its output.

23. The method as defined in claim 21 in which the correction signal is provided with a time constant small enough to maintain substantially constant the amplitude of the alternating signals as a coin passes through the alternating electromagnetic field but large enough to substantially eliminate from the correction signal components at the frequency of the alternating signal.

24. The method as defined in claim 21 in which the alternating signal is supplied by an oscillator including a transistor whose working point is controlled by the correction signal.

25. The method as defined in claim 24, in which the control signal is supplied to the transistor by means of an attenuator.

26. A coin checking apparatus comprising a circuit arrangement containing an oscillator operating at a predetermined frequency, a measuring coil provided for said oscillator, an influencing element for controlling the oscillator, the oscillator having an input and being influenced by a regulation magnitude delivered by the influencing element to said input such that the oscillator amplitude is regulatable without distortion in accordance with the regulation amplitude at the input of the oscillator, the oscillator including an oscillator circuit containing an amplification transistor, means for supplying a predetermined reference voltage for fixing the operating point of the amplification transistor of the oscillator circuit, a rectifier for rectifying an oscillator-measuring voltage tapped-off the measuring coil, a differential amplifier for forming the regulation magnitude from the difference of the rectified oscillator-measuring voltage and the reference voltage, a feedback loop leading to the input of the oscillator and having a timing element possessing a defined time-constant, the differential amplifier influencing by means of the feedback loop and the influencing element the oscillator such that the rectified oscillator-measuring voltage and the reference voltage substantially coincide, an evaluation circuit for comparing the regulation magnitude of the differential amplifier brought about by the influence of the coin upon the alternating-current field of the measuring coil with a predetermined potential window possessing a lower threshold value and an upper threshold value and accepting the coin when the amplitude of the regulation magnitude is located within the potential window, the time-constant of the timing element of the feedback loop and the differential amplifier is of sufficient magnitude that there does not occur any stabilizing of the half-waves of a non-rectified oscillator-measuring voltage but on the other hand so short that even when receiving as large as possible amplitude of the regulation magnitude as the criterion for the coin checking there does not occur any appreciable change of the oscillator-measuring voltage at the measuring coil during rapid throughpass of a coin, the timing element determining the time-constant of the feedback loop comprising a series circuit arrangement of a capacitor and a diode arranged parallel to a resistor, the diode preventing charging of the capacitor during small amplitude of the regulation magnitude and during large amplitude of the regulation magnitude permitting charging of the capacitor, the regulation magnitude for the coin checking being tapped-off between the capacitor and the diode of the timing element and delivered to the evaluation circuit.

27. A coin checking apparatus comprising a circuit arrangement containing an oscillator operating at a predetermined frequency, a measuring coil provided for said oscillator, an influencing element for controlling the oscillator, the oscillator having an input and being influenced by a regulation magnitude delivered by the influencing element to said input such that the oscillator amplitude is regulatable without distortion in accordance with the regulation amplitude at the input of the oscillator, the oscillator including an oscillator circuit containing an amplification transistor, means for supplying a predetermined reference voltage for fixing the operating point of the amplification transistor of the oscillator circuit, a rectifier for rectifying an oscillator-measuring voltage tapped-off the measuring coil, a differential amplifier for forming the regulation magnitude from the difference of the rectified oscillator-measuring voltage and the reference voltage, a feedback loop leading to the input of the oscillator and having a timing element possessing a defined time-constant, the differential amplifier influencing by means of the feedback loop and the influencing element the oscillator such that the rectified oscillator-measuring voltage and the reference voltage substantially coincide, an evaluation circuit for comparing the regulation magnitude of the differential amplifier brought about by the influence of the coin upon the alternating-current field of the measuring coil with a predetermined potential window possessing a lower threshold value and an upper threshold value and accepting the coin when the amplitude of the regulation magnitude is located within the potential window, the time-constant of the timing element of the feedback loop and the differential amplifier is of sufficient magnitude that there does not occur any stabilizing of the half-waves of a non-rectified oscillator-measuring voltage but on the other hand so short that even when receiving as large as possible amplitude of the regulation magnitude as the criterion for the coin checking there does not occur any appreciable change of the oscillator-measuring voltage at the measuring coil during rapid throughpass of a coin, the differential amplifier having a pair of inputs and an output and having a further feedback loop extending from the output of the differential amplifier to one of its inputs, said further feedback loop containing a null-value comparator connected in cascade as an integrator, said null-value comparator comparing the regulation magnitude delivered by the differential amplifier with ground and producing a regulation voltage which is delivered to one of the inputs of the differential amplifier as a correction magnitude for long-time changes, the time-constant of such further feedback loop being greater than the time-constant of the feedback loop leading to the input of the oscillator.

28. A coin checking apparatus comprising a circuit arrangement containing an oscillator operating at a predetermined frequency, a measuring coil provided for said oscillator, an influencing element for controlling the oscillator, the oscillator having an input and being influenced by a regulation magnitude delivered by the influencing element to said input such that the oscillator amplitude is regulatable without distortion in accordance with the regulation amplitude at the input of the oscillator, the oscillator including an oscillator circuit containing an amplification transistor, means for supplying a predetermined reference voltage for fixing the operating point of the amplification transistor of the oscillator circuit, a rectifier for rectifying an oscillator-measuring voltage tapped-off the measuring coil, a differential amplifier for forming the regulation magnitude from the difference of the rectified oscillator-measuring voltage and the reference voltage, a feedback loop leading to the input of the oscillator and having a timing element possessing a defined time-constant, the differential amplifier influencing by means of the feedback loop and the influencing element, the oscillator such that the rectified oscillator-measuring voltage and the reference voltage substantially coincide, an evaluation circuit for comparing the regulation magnitude of the differential amplifier brought about by the influence of the coin upon the alternating-current field of the measuring coil with a predetermined potential window possessing a lower threshold value and an upper threshold value and accepting the coin when the amplitude of the regulation magnitude is located within the potential window, the time-constant of the timing element of the feedback loop and the differential amplifier is of sufficient magnitude that there does not occur any stabilizing of the half-waves of a non-rectified oscillator-measuring voltage but on the other hand so short that even when receiving as large as possible amplitude of the regulation magnitude as the criterion for the coin checking there does not occur any appreciable change of the oscillator-measuring voltage at the measuring coil during rapid throughpass of a coin, the differential amplifier having a pair of inputs and an output and having, apart from the feedback loop leading to the input of the oscillator, a forward coupling from one of its inputs to its output, said forward coupling comprising a diode, a capacitor and a resistor connected in series, the time-constant of said forward coupling being greater than the feedback from the output of the differential amplifier to the input of the oscillator and being chosen in accordance with the normal speed of movement of the coin such that only rapid and large changes of the regulation magnitude lead to charging of said capacitor and are tapped-off between the capacitor and diode of the forward coupling and delivered to the evaluation circuit, however said forward coupling does not stabilize via the timing element slow and small changes of the output voltage of the differential amplifier.

29. A coin checking apparatus comprising a circuit arrangement containing an oscillator operating at a predetermined frequency, a measuring coil provided for said oscillator, an influencing element for controlling the oscillator, the oscillator having an input and being influenced by a regulation magnitude delivered by the influencing element to said input such that the oscillator amplitude is regulatable without distortion in accordance with the regulation amplitude at the input of the oscillator, the oscillator including an oscillator circuit containing an amplification transistor, means for supplying a predetermined reference voltage for fixing the operating point of the amplification transistor of the oscillator circuit, a rectifier for rectifying an oscillator-measuring voltage tapped-off the measuring coil, a differential amplifier for forming the regulation magnitude from the difference of the rectified oscillator-measuring voltage and the reference voltage, a feedback loop leading to the input of the oscillator and having a timing element possessing a defined time-constant, the differential amplifier influencing by means of the feedback loop and the influencing element the oscillator such that the rectified oscillator-measuring voltage and the reference voltage substantially coincide, an evaluation circuit for comparing the regulation magnitude of the differential amplifier brought about by the influence of the coin upon the alternating-current field of the measuring coil with a predetermined potential window possessing a lower threshold value and an upper threshold value and accepting the coin when the amplitude of the regulation magnitude is located within the potential window, the time-constant of the timing element of the feedback loop and the differential amplifier is of sufficient magnitude that there does not occur any stabilizing of the half-waves of a non-rectified oscillator-measuring voltage but on the other hand so short that even when receiving as large as possible amplitude of the regulation magnitude as the criterion for the coin checking there does not occur any appreciable change of the oscillator-measuring voltage at the measuring coil during rapid throughpass of a coin, the differential amplifier having an output, a voltage divider between the timing element of the feedback loop determining said time-constant and the input of the influencing element connected with the input of the oscillator, said voltage divider stepping down the regulation magnitude and thus producing a greater amplitude of the regulation magnitude at the output of the differential amplifier and which amplitude is employed for the coin checking operation.

30. A method of checking coins comprising the steps of: moving each coin to be checked through a constantly regulation alternating-current field of a measuring coil cooperating with an oscillator, influencing the alternating-current field by the coin to thereby form an oscillator-measuring voltage, rectifying the oscillator-measuring voltage, forming a regulation magnitude from the difference between a reference voltage and the rectified oscillator-measuring voltage, utilizing the regulation magnitude to readjust, by means of a feedback regulation circuit having a time constant and the oscillator, the oscillator-measuring voltage at the measuring coil to a substantially constant value, employing the regulation magnitude as coin checking criterion during checking of a coin in a manner such that there is determined by means of an evaluation circuit whether such regulation magnitude has reached a value located within an upper boundary and a lower boundary, and selecting the time-constant of the regulation magnitude fed back to the oscillator circuit as a function of the speed of movement of the coin to be checked so as to possess a magnitude sufficient that there does not occur any stabilization of half waves of the non-rectified oscillator-measuring voltage and further selecting such time-constant to be sufficiently short that even when obtaining a large amplitude of the regulation magnitude as the criterion for the coin checking there does not occur any appreciable change of the constant value of the oscillator-measuring voltage at the measuring coil during throughpassage of the coin.

31. In a method of checking coins wherein the field of an oscillator coil of a regulatable oscillator is dampened and wherein there is formed a feedback regulation magnitude from the difference between a rectified oscillator-measuring voltage and a reference voltage, which feedback regulation magnitude regulates the oscillator through an influencing element and wherein the feedback regulation magnitude is simultaneously employed as a measuring magnitude for the measurement of a coin, the improvement comprising regulating the oscillator so rapidly that there cannot arise any appreciable change in the oscillator amplitude and that by means of tap-off circuits there is tapped-off rapid and sudden changes of the regulation magnitude and delivering such rapid and sudden changes of the regulation magnitude to a detection circuit for the checking of the coins.

* * * * *